US010107072B2

(12) United States Patent
Harris et al.

(10) Patent No.: US 10,107,072 B2
(45) Date of Patent: Oct. 23, 2018

(54) TOE VALVE

(71) Applicant: Tercel Oilfield Products USA LLC, Houston, TX (US)

(72) Inventors: Michael Harris, Houston, TX (US); Kenneth J. Anton, Magnolia, TX (US)

(73) Assignee: Tercel Oilfield Products USA LLC, Houston, TX (US)

( * ) Notice: Subject to any disclaimer, the term of this patent is extended or adjusted under 35 U.S.C. 154(b) by 276 days.

(21) Appl. No.: 15/070,312

(22) Filed: Mar. 15, 2016

(65) Prior Publication Data

US 2017/0268313 A1 Sep. 21, 2017

(51) Int. Cl.

| | |
|---|---|
| ***E21B 34/14*** | (2006.01) |
| ***E21B 34/10*** | (2006.01) |
| ***E21B 34/06*** | (2006.01) |
| *E21B 34/00* | (2006.01) |

(52) U.S. Cl.

CPC ..... *E21B 34/10* (2013.01); *E21B 34/063* (2013.01); *E21B 34/102* (2013.01); *E21B 34/14* (2013.01); *E21B 2034/007* (2013.01)

(58) Field of Classification Search

CPC combination set(s) only.
See application file for complete search history.

(56) References Cited

U.S. PATENT DOCUMENTS

| | | | |
|---|---|---|---|
| 8,267,178 B1 | 9/2012 | Sommers et al. | |
| 8,555,960 B2 | 10/2013 | Mailand et al. | |
| 2005/0126787 A1 | 6/2005 | Gomez | |
| 2011/0100643 A1 | 5/2011 | Themig et al. | |
| 2013/0025872 A1 | 1/2013 | Mailand et al. | |
| 2014/0374096 A1 | 12/2014 | Anton et al. | |
| 2015/0184489 A1 | 7/2015 | Resweber | |
| 2015/0369040 A1 | 12/2015 | George et al. | |
| 2016/0168949 A1* | 6/2016 | Anton | E21B 34/10 166/374 |

FOREIGN PATENT DOCUMENTS

WO 2015/069909 A1 5/2015

OTHER PUBLICATIONS

Halliburton, RapidStart® Initiator CT Sleeve, Sep. 2015, 2 pp.

* cited by examiner

*Primary Examiner* — D. Andrews
*Assistant Examiner* — Ronald R Runyan
(74) *Attorney, Agent, or Firm* — Keith B. Willhelm

(57) ABSTRACT

A tool includes a housing between an outer wall and an inner wall that surrounds a longitudinal tool bore. First and second axially spaced ports connect the housing to the tool bore. An unlocking piston seals across the first port and an arming sleeve seals across the second port. A Locking ring is held in place by a retaining ring and prevents the arming sleeve from sliding towards the unlocking piston to open the second port. An unlocking tool bore pressure at the first port moves the unlocking piston axially to displace the retaining ring and unlock the tool. A lower, arming tool bore pressure moves the arming sleeve in the unlocked tool to open the second port and arms the tool. An actuating tool bore pressure, which is less that the unlocking pressure, actuates a valve piston via the open second port.

21 Claims, 10 Drawing Sheets

TOE VALVE

BACKGROUND OF THE INVENTION

Technical Field

The present invention relates generally to an apparatus for deploying a downhole well bore tool by cycling fluid pressure in the well bore and methods relating thereto. More particularly, this invention pertains to a toe valve that can be opened by exposing the tool to a series of different tool bore pressures, as well as related methods.

Description of Related Art

As is well known, wells have been drilled into ground formations to search for and produce oil, gas and water from underground reservoirs and also, sometimes, to inject and store gases and other fluids in these reservoirs. These wells typically extend vertically for long distances into the subsurface but also have been drilled to deviate from the vertical and, at times, to extend horizontally. Periodically during the drilling process, drilling may be suspended so that tubular casing can be lowered into the well to line the well's walls, maintain well integrity and prevent the well from collapsing. Conventionally, tubular casing comes in lengths, sometimes called joints. Male and female threads at opposing ends of each joint allow joints to be assembled at the wellhead as the joints are being run into the well as part of a tubular string.

Once a sufficient quantity of casing has been connected into a string and run in to a desired depth in the well, the casing is generally cemented into place. After the casing is cemented, drilling can continue to extend the well still further until the subsurface target is reached. Several strings of casing can be cemented in a well. Subsequent strings of casing are generally of smaller diameter than the previous strings so that later strings are inserted through the bores of previous strings.

Typically in a cementing operation, surface pumps pump cement into the bore of the casing string to be cemented. A wiper device, such as a wiper plug, cement plug or bottom plug can precede the cement to keep the cement separate from the well fluids, such as drilling mud or water already in the well. Another cement plug, sometimes called a top plug, can also be pumped down immediately following the cement to wipe the interior surfaces of the casing clean. When the bottom plug reaches a device such as a landing collar near the bottom of the casing, the landing collar prevents the bottom plug from moving further and pressure builds up behind the bottom plug. The bottom plug can include a diaphragm which ruptures under the differential pressure produced by the pressure buildup allowing cement to exit the casing string. The cement is pumped through the opening at the end of the casing string and begins to return to the surface in the annular volume of the well bore between the new casing and the formation. Pumping continues until the top plug reaches the bottom plug and the pumping pressure again increases signifying that all the desired cement has been displaced from the tubular string.

As will be understood from the above description of a cementing operation, in addition to casing joints, the tubular string can include other components. In addition to landing collars, the tubular string can include, for example, float collars and a float shoe. These components can be useful during the cementing operation. A float shoe is generally placed at the end of a tubular string and includes a check valve that prevents the denser cement slurry in the annulus from flowing back into the casing string against the less dense displacing fluid in the tubular string, when cementing pumps stop at the end of the pumping operation. The check valve can also be used to limit the quantity of well fluid that enters the casing string as it runs into the well, rendering the string somewhat buoyant and reducing the lifting load on the surface equipment. Thus, the tubular string partially floats as it is lowered into the well. Float shoes can further include centralizers that keep the leading end of the tubular string away from the side walls of the well, where rocks and protrusions may damage the end of the string as it runs into the well.

Similar to a float shoe, a float collar can include a check valve to prevent the reverse flow of cement and other fluids from the well bore into the tubular string. Also, similar to a landing collar, a float collar can include a barrier in the tubular bore where cement plugs can land. Because a float collar is generally placed at a distance above the end of a tubular string, the end portion of the string below the float collar may be plugged with cement at the end of the cement pumping operation. If the tubular string includes a float shoe in addition to a float collar, the check valve in the float collar can provide additional safety and redundancy in checking the inflow of well fluids into the string.

After a well is drilled to a desired depth and cemented, several methods have been used to establish fluid communication between the well bore and a target reservoir in a subsurface formation. In one commonly used technique, perforating guns containing shaped charges can be lowered to the desired position in the well and detonated. The shaped charges are oriented laterally to perforate the casing and blow holes radially through the cement and into the formation.

Toe valves can be used as an alternative for establishing fluid flow between the well bore and a desired formation. Commonly, in this alternative, a toe valve can be placed in the tubular string above landing collars and float collars. The toe valve is generally a tubular tool with a bore aligned with the rest of the tubular string. The toe valve also includes valve ports extending radially through in its side walls which can be opened after cementing is completed to expose the cement and formation surrounding the tool. Pumps at the surface can pump fluid into the tubular string to apply fluid pressure through the ports of the opened toe valve. The fluid pressure can produce perforations or fractures in the cement and formation surrounding the ports and, thus, establish fluid communication between the tool bore and the formation.

Toe valves have been designed to include a variety of mechanisms to open their ports in response to pressure applied in the tool bore. In one type of known toe valve, the valve includes a mechanism that must be exposed to high fluid pressure for a period of time. Such mechanisms can include a viscous gel-like material that must be expelled through a narrow circuitous orifice by fluid pressure in the tool bore before the mechanism can open the valve. In another type of toe valve, tool bore pressure must simply exceed a set high value in order to open the toe valve's ports.

Commonly, well operators pressure test a cemented casing string to ensure the integrity of the casing and check for leaks between casing joints. In many instances, this pressure testing is most conveniently completed before opening the toe valve. Preferably, pressure testing is performed at a pressure above the maximum pressure likely to be observed in the well. Toe valves designed to open by the application of a high pressure can be problematic because casing integrity pressure tests should be performed at a pressure lower than the toe valve opening pressure to prevent prematurely opening the toe valve. Moreover, subsequently applying a higher pressure to open the toe valve after the integrity pressure test may unintentionally damage the casing or create leaks that did not exist during testing. FIG. 12 illustrates this problem and shows exemplary surface pressures that may be applied over time to the tubular string bore to perform a pressure test and open such a toe valve. In this example, surface pumps apply increasing fluid pressure to the tubular string bore until achieving a desired casing pressure test pressure of 9000 psi and the pressure is held at that point until the pressure test is successfully completed. After the successful test, pumps increase pressure to 10,000 psi (notably higher than the casing test pressure), at which point the toe valve opens and pressure in the tubular string bleads off rapidly with the pumps turned off. Toe valves that delay opening when a high pressure is applied to the tubular string can also be problematic in offering limited opportunity to complete high pressure integrity tests.

Other toe valves have attempted to overcome this problem by providing a partial constriction or seat in the tool bore. When opening the toe valve, for example, after the casing pressure test, a ball is dropped into the tool onto the seat. Pumps apply fluid pressure in the bore above the ball and the differential pressure across the ball is used to push down on the seat and open the valve. However, once the seat is occluded by the ball, later access to the well below the toe valve may be difficult. Furthermore, dropping a ball to seat at the toe valve may be impractical where the valve is located along a horizontal portion of the well.

BRIEF SUMMARY OF THE INVENTION

In one embodiment, a downhole tool is adapted for assembly into a tubular string for a well. The tool comprises a main chamber between an outer wall and an inner wall. The inner wall surrounds an axial bore. There is a first port and a second port in the inner wall. The first and second ports are spaced axially relative to each other. An unlocking piston is slidably mounted in the main chamber. An arming sleeve is slidably mounted in the main chamber. The arming sleeve is releasably locked in a position covering the second port. The unlocking piston is adapted for actuation by a pressure at the first port to unlock the arming sleeve. The arming sleeve, after being unlocked by the unlocking piston, is adapted for actuation in response to lowering the pressure at the first port to uncover the second port.

Optionally, such embodiments can also include a lock ring releasably affixed at an axial position in the main chamber between the first piston and the arming sleeve, and a capture ring radially adjacent to the lock ring. The capture ring and the lock ring are radially retained between the outer wall and the inner wall. They also may further comprise a lock ring releasably affixed at an axial position in the main chamber between the unlocking piston and the arming sleeve. The releasable lock ring retains the arming sleeve in the position covering the second port. A displaceable capture ring is disposed between the lock ring and the outer wall. The capture ring retains the lock ring in the axial position.

In an alternative option, the first piston can be located in the main chamber and coupled to the inner wall to seal across the first port and to slide axially on the inner wall. The first port can also include a rupture disk sealing between the first piston and the axial bore, and the arming sleeve can be located in the main chamber coupled to the inner wall to seal across the second port and to slide axially thereon. In other embodiments, the unlocking piston is slidably mounted on and around the inner wall and has an inner actuation surface providing a hydraulic chamber between the unlocking piston and the inner wall. The first port is adapted to provide fluid communication between axial bore and the hydraulic chamber. In still other embodiments the arming sleeve is slidably mounted on and around the inner wall and seals across the second port.

In a further option, the outer wall includes a valve port, and the tool further comprises a valve piston slidably mounted on and within the outer wall. The valve piston has an initial position covering the valve port. The valve piston is adapted for actuation by a pressure at the uncovered second port to uncover the valve port. The pressure at the uncovered second port is less than the pressure applied at the first port to unlock the arming sleeve. Also, the downhole tool can include a second chamber between the outer wall and the valve piston which has a pressure lower than the pressure at the second port which is capable of actuating the valve piston.

In an alternative embodiment, a toe valve can have an outer tubular wall with a longitudinal axis, an inner tubular wall concentrically disposed within the outer wall and surrounding an axial bore, and a first chamber between the outer wall and the inner wall. The inner wall can have a first port therethrough and a second port therethrough axially separated from the first port, wherein the first port includes a rupture disc forming a breakable seal between the bore and the first chamber. An axially slideable unlocking piston in the first chamber has an actuating surface sealed across the first port, an axially slideable cover ring in the first chamber and having an inner surface sealed across the second port and a spring loaded against the cover ring in an axial direction towards the first annular piston. The first chamber an also include a lock ring releasably affixed at an axial position in the first chamber between the first annular piston and the cover ring, and a capture ring radially adjacent to the lock ring, wherein the capture ring and the lock ring are radially retained between the outer wall and the inner wall. Other toe valve embodiments are adapted for assembly into a tubular string for a well. The toe valve comprises an outer tubular wall and an inner tubular wall. The inner tubular wall is concentrically disposed within the outer wall and surrounds an axial bore. The inner wall has a first port and an axially spaced second port. A first chamber is between the outer wall and the inner wall. An unlocking piston is slidably mounted in the first chamber and has an inner actuation surface providing a hydraulic chamber between the unlocking piston and the inner wall. The first port has a rupture disc forming a breakable seal between the axial bore and the hydraulic chamber. An arming sleeve is slidably mounted in the first chamber. The arming sleeve covers a second port which is spaced axially from the first port. A spring is loaded against the arming sleeve and biases the arming sleeve in an axial direction towards the unlocking piston. A lock ring is releasably affixed at an axial position in the first chamber between the unlocking piston and the arming sleeve. A capture ring is disposed between the lock ring and the outer wall.

Optionally, the toe valve can include a second piston coupled to the first chamber and actuated in response to a pressure at the second port. A valve port can form an opening through the outer wall, and a substantially annular second piston can be mounted to seal against an inner surface of the outer wall and form a second chamber sealed between the second piston and the inner surface. In other embodiments, the toe valve comprises a second piston hydraulically coupled to the first chamber and actuatable in response to a hydraulic pressure in the first chamber. The toe valve also may have a valve port in the outer wall. The second piston may be a valve piston adapted for actuation from a position covering the valve port to a position where the valve port is uncovered. The valve piston may form a second chamber between the valve piston and the outer wall. The valve piston may be adapted to uncover the valve port in response to a hydraulic pressure in the first chamber greater than a pressure in the second chamber.

According to another option, the second piston of the toe valve can be coupled to slide between a first position to close the valve port and a second position, axially displaced from the first position, to open the valve port. Further, the unlocking piston can be moved to a second position axially spaced from a first position, wherein in the second position, the unlocking piston displaces the capture ring into a recess in the cover ring. Also, in some options, the unlocking piston can move from the first position to the second position by applying a fluid pressure greater than a selectable unlocking fluid pressure at the first port. In yet other options, the first port can also include a rupture disk for setting a selectable unlocking fluid pressure. In other options, the unlocking piston is moveable from a first position to a second position to displace the capture ring into a recess in the arming sleeve. The unlocking piston may be moveable from the first position to the second position by applying a fluid pressure greater than a selectable unlocking fluid pressure at the first port. The rupture disk may be adapted to rupture at the unlocking fluid pressure.

According to a still further option, the toe valve cover ring is moveable from a first position, wherein the inner surface of the cover ring is sealed across the second port, to a second position axially spaced from the first position, wherein the cover ring displaces the lock ring and opens the second port. Also in an alternative option, the cover ring can move from the first position to the second position when a fluid pressure applied at the first port is reduced from a fluid pressure above an unlocking pressure to a fluid pressure below the unlocking pressure. In yet other options, the arming sleeve is moveable to displace the lock ring and uncover the second port. The arming sleeve may be moveable in response to reducing fluid pressure applied at the first port from the unlocking fluid pressure.

A further embodiment provides a method of deploying a downhole tool, the tool having a substantially tubular outer tool wall, a substantially annular housing within the tool wall and a concentric axial tool bore extending through the housing. The tool bore contains a fluid having a fluid pressure. The method includes increasing the fluid pressure in the tool bore to a pressure to unlock the tool, reducing the fluid pressure in the tool bore to open a port in the housing adapted to allow fluid communication between the housing and the axial bore, and increasing the fluid pressure in the tool bore to a second pressure to induce fluid flow through the open port and actuate the tool, wherein the second pressure is less than the first pressure.

Optionally, unlocking the tool can include moving a first piston in the housing from a first position to a second position axially spaced from the first to unlock a housing port, wherein the first piston has an actuating surface in fluid communication with the tool bore. Unlocking the tool also can comprise moving an unlocking piston in the housing from a first position to a second position axially spaced from the first position to unlock an arming sleeve. The unlocking piston has an actuating surface in fluid communication with the tool bore.

According to another option, arming the tool can include moving an arming sleeve from a sealed position across a port in the housing to an unsealed position to allow fluid communication between the housing and the axial bore and actuating the tool can include applying the fluid pressure through an open housing port. In other options arming the tool comprises moving an arming sleeve to uncover a port in the housing and allow fluid communication between the housing and the axial bore. Actuating the tool may comprise applying a fluid pressure through an open housing port. According to an aspect of this method, the tool can further include a valve port forming an opening in the outer tool wall and an actuating piston or valve piston coupled to and in fluid communication with the housing, and actuating can further include axially displacing the actuating piston or valve piston in response to the fluid pressure applied through the open housing port.

DETAILED DESCRIPTION OF THE INVENTION

Figure 1:
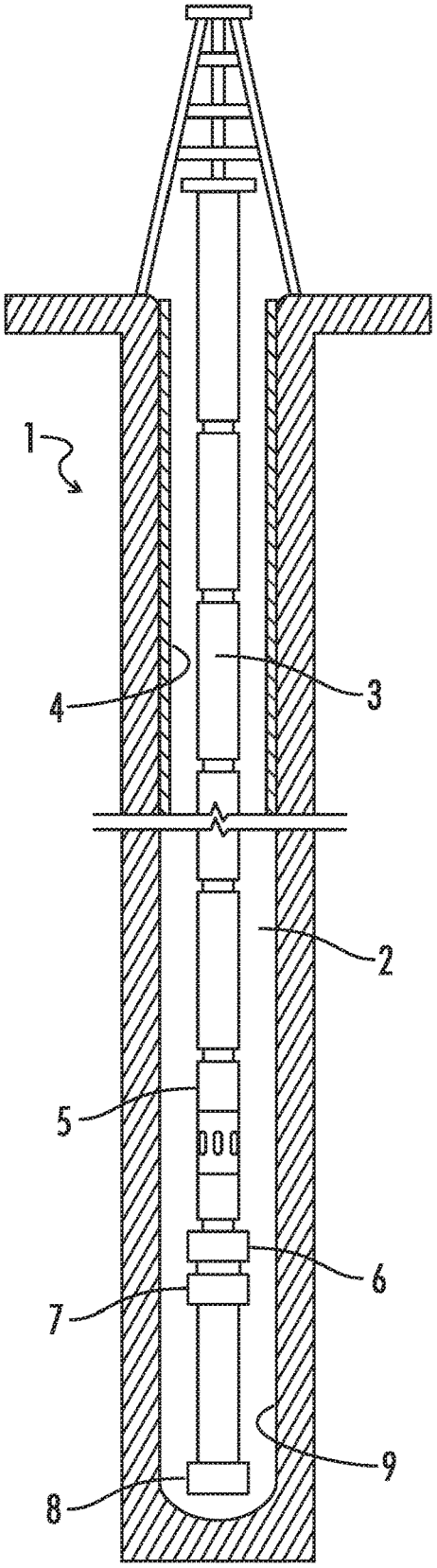
FIG. 1 is a schematic diagram of a tubular string including a toe valve suspended in a well for a cementing operation.

As shown in FIG. 1, toe valve 5 is a tool that can be included in a tubular string lowered downhole into well 1 which is drilled into the ground or a subsurface formation. The well bore 2 of well 1 can include cased hole portions where the well bore is lined with outer casing 4 cemented to the surrounding formation. Well 1 can extend downhole beyond outer casing 4 and include open hole portions 9 not yet cased and cemented. The tubular string can include joints of casing 3 that extend through outer casing 4 and into the open hole portion 9 of well 1. Toe valve 5 can be disposed in accordance with conventional practice towards the end of tubular string. The toe valve 5 may be, for example, three or four joints from the bottom of the casing or the tubular string. The joints below the toe valve may include, for example, a landing collar 6, a float collar 7 and a float shoe 8.

The tubular string shown in FIG. 1 can be used for cementing open hole portions 9 of well 1. Conventionally in such cementing operations, cement can be pumped down through casing joints 3, toe valve 5, and lower joints of tubular string, followed by a cement plug or other wiper device. The cement plug helps to ensure that residual cement is wiped off the inside walls of the tubing string and is displaced outwards through the float shoe 8. Cement pumped out of float shoe 8 rises up to fill a desired height in the annular volume of well bore 2 and cements the tubular string in place. Once the tubular string is cemented in place, the string is preferably pressure tested, by pumping fluid into the bore of the tubular string to a desired test pressure, to check the integrity of casing and other joints, as well as to check for leaks between joints. According to one aspect, toe valve 5 can be unlocked by this increase in fluid pressure in the bore of the tubular string to the test pressure, thereby permitting subsequent operation of toe valve by applying a sequence of lower pressures in the bore of the tubular string.

Figure 2:
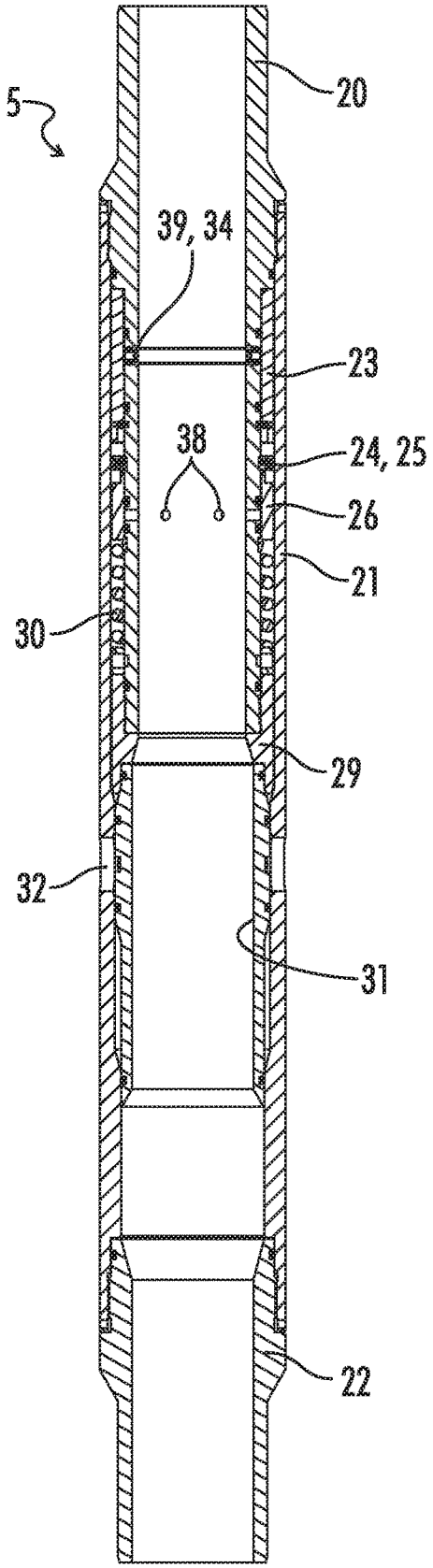
FIG. 2 is a cross sectional view of one embodiment of the toe valve of FIG. 1.
Figure 3:
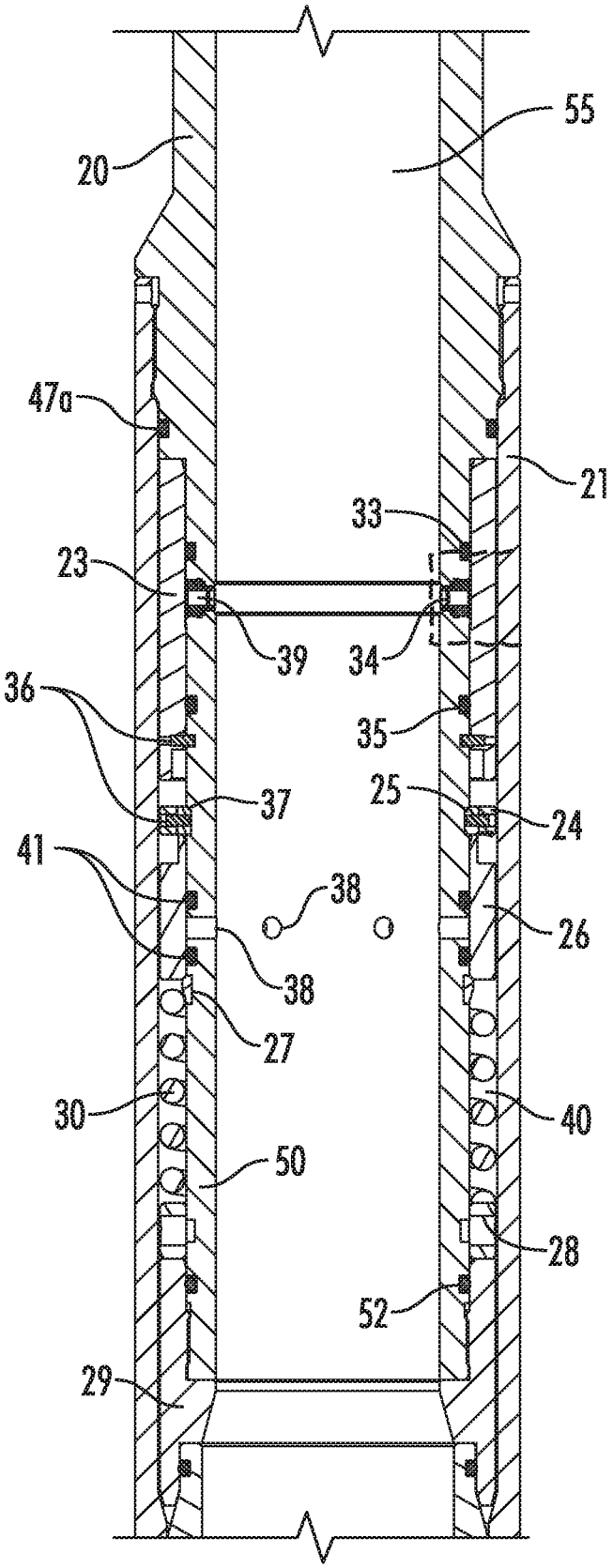
FIG. 3 is an expanded cross sectional view of the toe valve of FIG. 2.
Figure 3A:
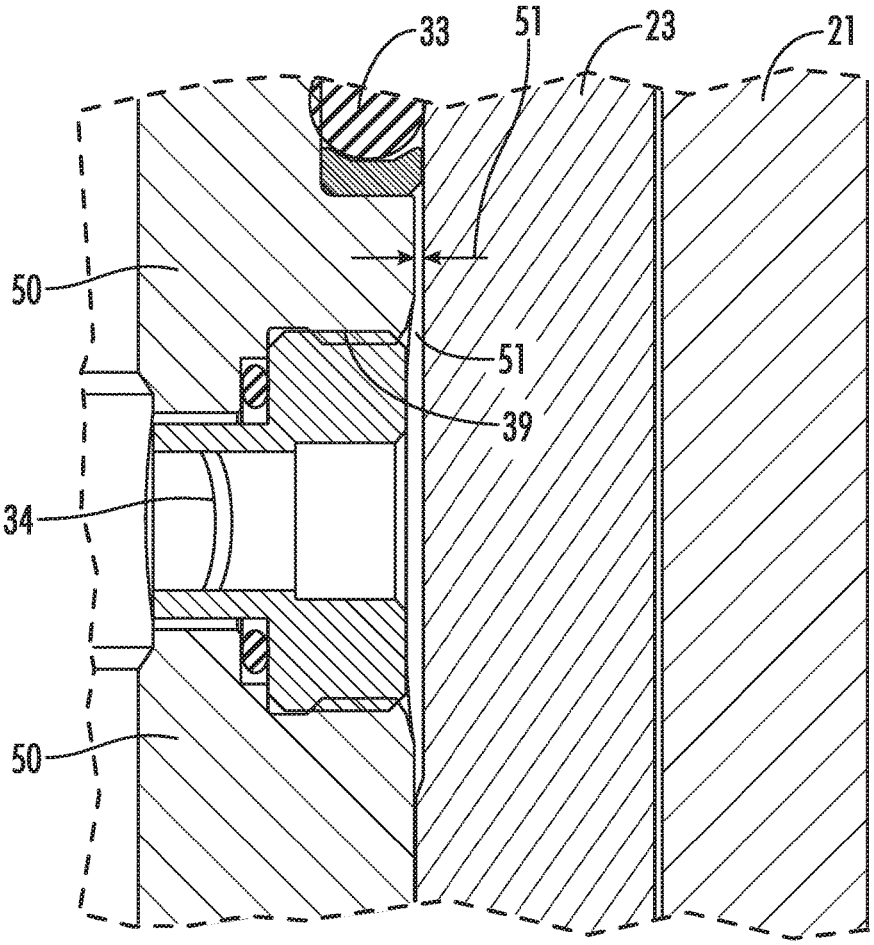
FIG. 3A is a further expanded cross sectional view of a portion of FIG. 3.
Figure 4:
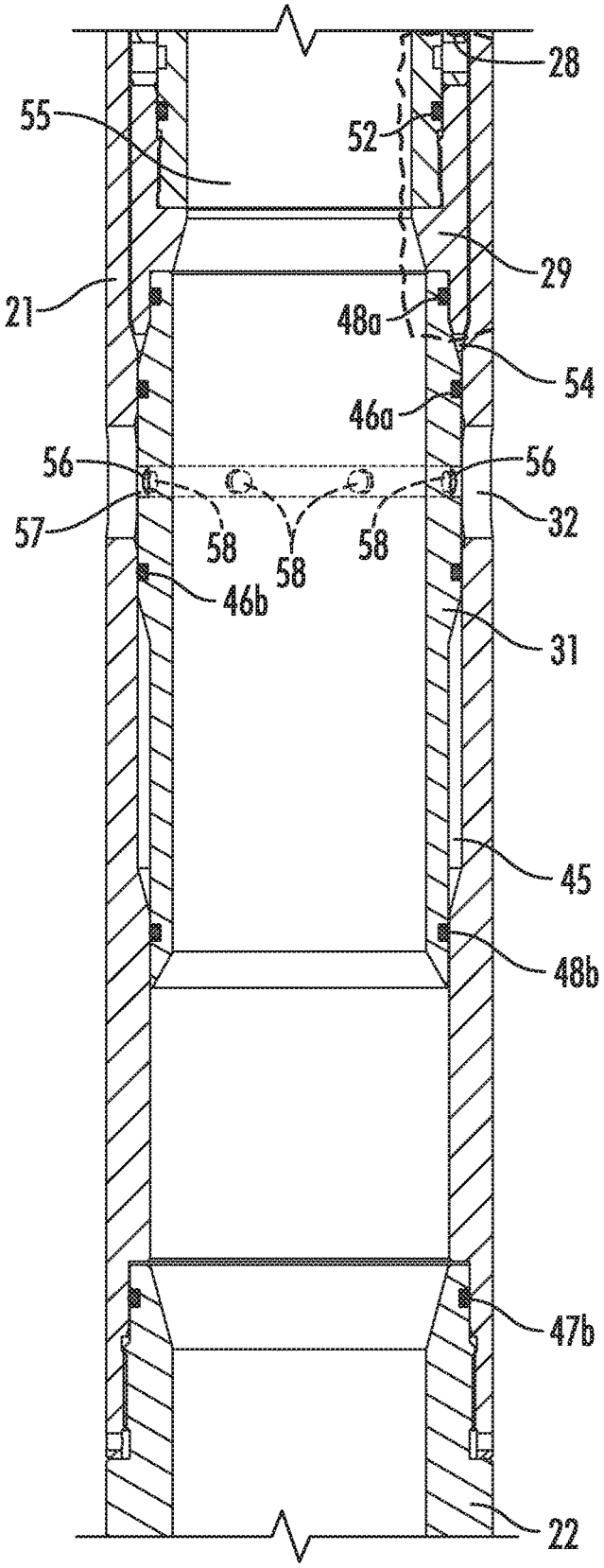
FIG. 4 is an alternate cross sectional view of the toe valve of FIG. 2.
Figure 4A:
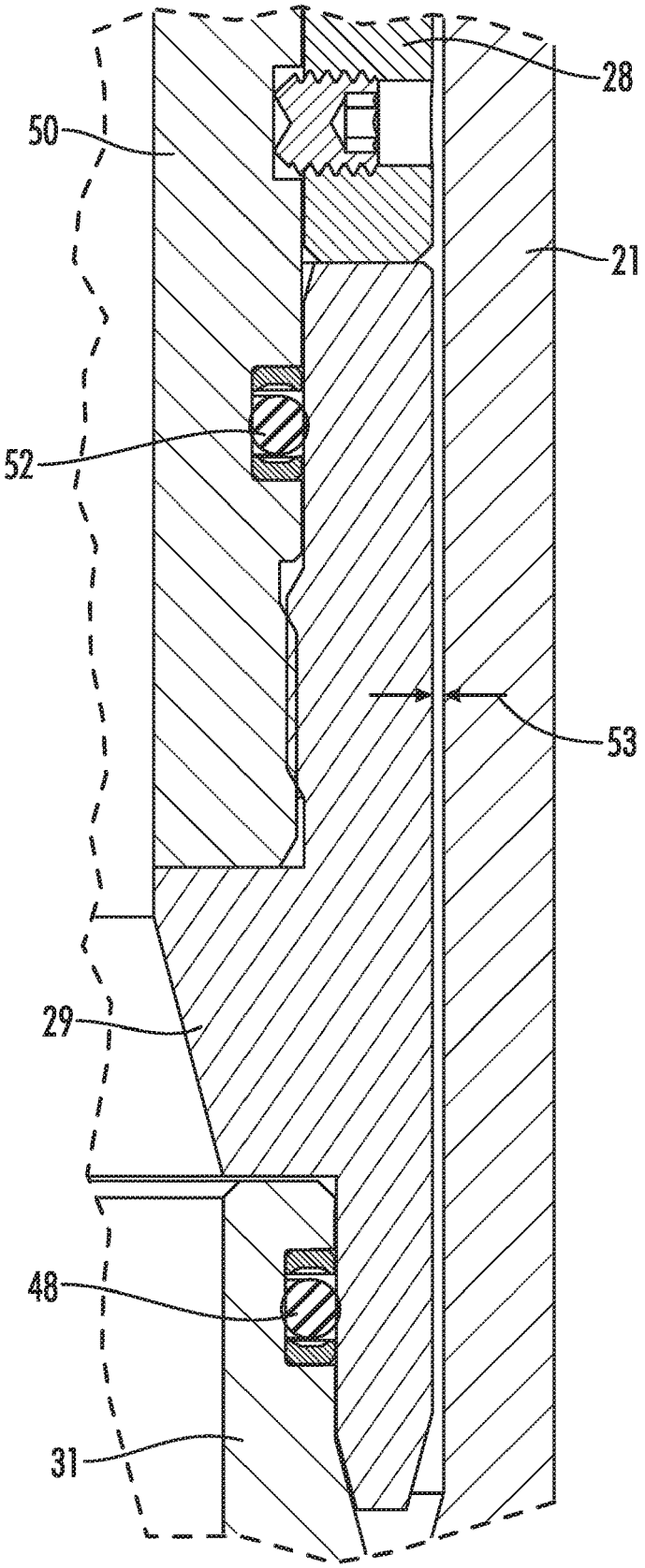
FIG. 4A is a further expanded cross sectional view of a portion of FIG. 4.

As shown in FIGS. 2-4, toe valve 5 includes a substantially tubular or cylindrical outer wall 21 that encloses a housing. The toe valve 5 has a longitudinal axis at its center and a tool bore 55, which is an opening that extends through the toe valve 5 along its longitudinal axis. Preferably, the tool bore 55 is in fluid communication with fluid in the bore of the tubular string. For convenience, the end of toe valve 5 conventionally mounted closest to the surface as toe valve 5 is lowered into the well 1 can be referenced as the up-hole, or upper end, while the opposite end of toe valve 5 can be referenced as the lower or downhole end. Despite this naming convention, it is understood that many portions of the well bore may not be vertically oriented and that the tool may actually be in any orientation as dictated by the local well bore orientation, which may include horizontal portions.

It will be understood that the outer wall 21 may not be perfectly circular in cross section and may be polygonal, elliptical or include some planar surfaces, protrusions or recesses to suit tool design or downhole requirements. However, the toe valve is sufficiently tubular or cylindrical to fit within well bore 2.

Toe valve 5 also includes an inner wall 50 which can be an extension of top sub 20. Inner wall 50 is spaced radially inwards from outer wall 21 and is generally concentric with the outer wall 21. The housing of the toe valve 5 is formed in the annular space between the outer wall 21 and the inner wall 50. Inner wall 50 surrounds tool bore 55. Top sub 20 can be attached to outer wall 21 at its up-hole end via a connection sealed by upper housing seal 47*a*. At the downhole end of the housing, annular nut 29 extends into annular space between outer wall 21 and inner wall 50, and can couple to the inner wall 50 via a nut seal 52 to seal between the housing and the tool bore 55. The lower end of outer wall 21 can be connected to bottom sub 22 with lower housing seal 47*b* sealing tool bore 55 from the annular volume of well bore 2.

The housing can include a generally annular unlocking piston 23 and a cover ring 26 axially spaced from unlocking piston 23. Both unlocking piston 23 and cover ring 26 can be mounted around and coupled to slide axially along the inner wall 50. Cover ring 26 can have an annular sleeve shape and can fully or partially surround a length of inner wall 50. Cover ring 26 may also be referred to as an arming sleeve. However, in some embodiments, unlocking piston 23 and cover ring 26 may not be perfectly circular in cross section and may be polygonal, elliptical or include some planar surfaces, protrusions or recesses. Also, in some embodiments, unlocking piston 23 may not completely surround inner wall 50. Nonetheless, unlocking piston 23 and cover ring 26 should have inner surfaces that generally conform to the outer surface of inner wall 50 so as to slide axially along inner wall 50 and provide a good seal across unlocking piston port 39 and housing port 38.

Lock ring 25 can be a split ring made from a hoop of material split radially at a point on the hoop. Preferably the lock ring 25 can be made of a metal, such as spring steel or other substance that is resiliently elastic, so that although initially received in a groove 37 in an outer surface of inner wall 50, lock ring 25 can be readily removed from the groove 37 if there is no radial restraint, and yet resist a moderate axial force while received in groove 37. The hoop of lock ring 25 can be generally rectangular with a bevel along an inner edge facing the inner wall 50. The beveled inner edge of lock ring 25 can be complementary to the shape of groove 37 which also has a beveled corner in inner wall 50 and so facilitates displacing lock ring 25 from groove 37 by application of the moderate axial force exerted by the cover ring 26, unless lock ring 25 is retained radially within groove 37.

Capture ring 24, disposed between lock ring 25 and an inner surface of outer wall 21, has a radial thickness corresponding to the radial gap between the lock ring 25, received in groove 37, and the inner surface of outer wall 21, thereby retaining lock ring 25 in groove 37 and preventing its axial movement. Groove 37 is located between unlocking piston 23 and cover ring 26. Spring 30 is compressed between anti-rotation ring 28 and nut 29 on one side and cover ring 26 on the other. Spring 30 is loaded against cover ring 26, pushing cover ring 26 against lock ring 25 in the direction of unlocking piston 23. Anti-rotation ring 28 facilitates assembly and can include a hole through which a pin or locking screw can be inserted to extend into a recess in the inner wall 50 to hold spring 30 in place as outer wall 21 and nut 29 are being attached. Stroke ring 27 can be received in a groove to restrict the axial motion of the cover ring 26 in the direction of the spring 30. It will be understood that unlocking piston 23, capture ring 24 and lock ring 25 can include shear pins and other temporary fasteners 36 to facilitate assembly of the toe valve 5.

Cover ring 26 includes a recess to receive capture ring 24. Unlocking piston 23 includes a member that extends axially from the end of unlocking piston 23 closest to capture ring 24. In an axial motion of unlocking piston 23 towards cover ring 26, the member can displace retaining capture ring 24 axially from the radial gap between the lock ring 25 and the outer wall 21 into the recess of the cover ring 26. Unlocking piston 23 sits over unlocking port 39 which is an opening extending through inner wall 50 to the tool bore 55. Unlocking port 39 can include a rupture disk 34 sealed across the opening that can be selected to break at a desired fluid pressure differential. Rupture disk 34 prevents the unlocking piston 23 from actuating until a desired pressure is reached in the tool bore 55, thus preventing toe valve 5 from being unlocked prematurely. Unlocking piston upper seal 33 and unlocking piston lower seal 35 straddle unlocking port 39 and form a fluid-tight seal between the inner wall 50 and the unlocking piston 23 preventing fluids in the tool bore 55 from entering the remaining housing volume once rupture disk 34 is broken.

Though not immediately apparent in the figures because of its relatively small dimensions, unlocking piston 23 has a surface facing the inner wall 50 and unlocking port 39 therein which provides an actuating surface for unlocking piston 23. The actuating surface can be tapered, staggered or otherwise shaped so that the inside diameter of the unlocking piston 23 at or near unlocking piston lower seal 35 is slightly smaller than the diameter of the unlocking piston 23 at or near unlocking piston upper seal 33. That diameter differential provides a hydraulic chamber 51, allowing fluid pressure applied to the actuating surface via unlocking port 39 to push unlocking piston 23 towards capture ring 24. Unlocking piston lower seal 35 and upper seal 33 can be appropriately sized and configured to maintain a fluid tight seal between inner wall 50 and actuating surface of the unlocking piston 23.

When held back by lock ring 25 in groove 37, cover ring 26 sits over housing port 38. Housing port 38 is an opening in the inner wall 50 that extends from the housing into tool bore 55. Housing port seals 41 straddle housing port 38 to form a fluid-tight seal between cover ring 26 and inner wall 50 when the cover ring 26 sits over and, thereby, closes housing port 38. Though not immediately apparent in the figures because of their relative small dimensions, it will be appreciated that tolerances and gaps exist between outer wall 21 on the one hand, and unlocking piston 23, capture ring 24, cover ring 26 and anti-rotation ring 28 on the other. These gaps and tolerances permit fluid communication between portions of the housing not sealed off by unlocking upper and lower piston seals 33, 35, housing port seals 41, nut seal 52 and upper housing seal 47*a* to form a main chamber 40. Thus, main chamber 40 can be at a substantially lower pressure than tool bore 55 when housing port 38 is closed.

It will be appreciated that the actuating surface on unlocking piston 23 defines a relatively small, annular hydraulic chamber between unlocking piston 23 and inner wall 50 which is isolated from the rest of the housing volume, i.e., from main chamber 40, by unlocking piston upper seal 33 and unlocking piston lower seal 35. With housing port 38 closed and sufficient pressure applied at unlocking port 39 to break rupture disk 34, fluid will enter the hydraulic chamber and urge unlocking piston downward against the substantially lower pressure in main chamber 40. As unlocking piston 23 slides axially towards and impacts capture ring 24, capture ring 24 will be displaced into the recess in cover ring 26, thus unlocking toe valve 5 and permitting actuation of the tool by subsequently applying a series of lower fluid pressures in tool bore 55. When the pressure applied at unlocking port 34 falls sufficiently after toe valve 5 has been unlocked, the cover ring 26, impelled by spring 30, displaces locking ring 25 axially out of groove 37. The continued sliding motion of cover ring 26 pushes unlocking piston 23 backwards and opens housing port 38 in the process. Toe valve 5 is now armed by the motion of cover ring 26, allowing fluid pressure in the tool bore to be applied to the main chamber and actuate the toe valve 5 as fluid pressure in the tool bore 55 is increased. It will be understood that the above-described mechanism for unlocking, arming and actuating a downhole tool is not limited to toe valves 5. The mechanism can be used to deploy a wide range of tools by similarly manipulating tool bore fluid pressure.

As best seen in FIG. 4, toe valve 5 includes a valve port 32 that forms an opening through outer wall 21. Valve piston 31 can be generally cylindrical, with external surfaces shaped to couple with the inner surfaces of outer wall 21. Valve piston 31 also includes a longitudinal axial bore. The outer cylindrical surfaces of valve piston 31 include an upper piston seal 48*a* circumferentially mounted near an upper end of valve piston 31, a lower piston seal 48*b* circumferentially mounted near a lower end of valve piston 31, and upper valve seal 46*a* and lower valve seal 46*b* circumferentially mounted at upper and lower intermediate positions, respectively, on the valve piston 31. Valve piston 31 is mounted concentrically in outer wall 21 so that its axial bore aligns with the remainder of the tool bore 55 and forms an extension thereof. Shear screws 58 extend through threaded holes 56 into shear screw groove 57 in valve piston 31 to hold valve piston 31 in place during storage and before it is actuated. Low pressure chamber 45 can be generally annular and formed between the outer wall 21 and a portion of valve piston 31 between lower piston seal 48*b* and lower valve seal 46*b*.

Valve piston 31 is coupled to slide axially along the tool bore 55. In an upper position, valve piston 31 couples with an annular flange on nut 29 that extends axially in a downhole direction. With valve piston 31 in this position, upper and lower valve seals 46*a*, 46*b* straddle valve port 32 closing the port and keeping fluids in tool bore 55 separated from the annular volume of well bore 2. Though not immediately apparent in the figures because of the relatively small dimensions, it will be appreciated that nut 29 can include gaps or tolerances 53 between its peripheral surface and the outer wall 21 to allow fluid from main chamber 40 to flow into and communicate with the high pressure chamber 54 immediately adjacent the outer annular surface of the valve piston 31 between the upper piston seal 48*a* and the upper valve seal 46*a*. The outer annular surface of the valve piston 31 between the upper piston seal 48*a* and the upper valve seal 46*a* forms an actuating surface on valve piston 31, so that pressure in the high pressure chamber 54 will apply an axial downward force on valve piston 31. Thus, valve piston 31 is also hydraulically coupled to main chamber 40 via the gaps or tolerances around nut 29. Upper piston seal 48*a* prevents fluid in the tool bore 55 communicating with fluid in the high pressure chamber 54, while upper valve seal 46*a* prevents fluid in the high pressure chamber 54 from communicating with the annular volume of well bore 2.

When toe valve 5 is armed, the pressure in main chamber 40 equalizes with the pressure in the tool bore 55. To open the toe valve 5, pressure in the tool bore is increased causing fluid to flow through now open housing port 38 into main chamber 40, past nut 29, and into high pressure chamber 54. Consequently, pressure in the high pressure chamber 54 will increase until the difference between the pressure in the high pressure chamber 54 and the pressure in the low pressure chamber 45 produces a net force on the valve piston 31 sufficient to shear out shear screws 58 and displace valve piston 31 axially away from nut 29. As valve piston 31 is displaced away from nut 29, the fluid-tight seal between valve piston 31 and nut 29 is broken, the pressure from fluids in the tool bore 55 continue to apply an axial force on the actuating surface of valve piston 31 that exceeds the opposite force produced by the lower pressure in the low pressure chamber 45. Thus, valve piston 31 continues to move axially away from nut 29 at least until upper valve seal 46*a* and lower valve seal 46*b* no longer straddle and seal valve port 32, thereby opening valve port 32.

Figure 9:
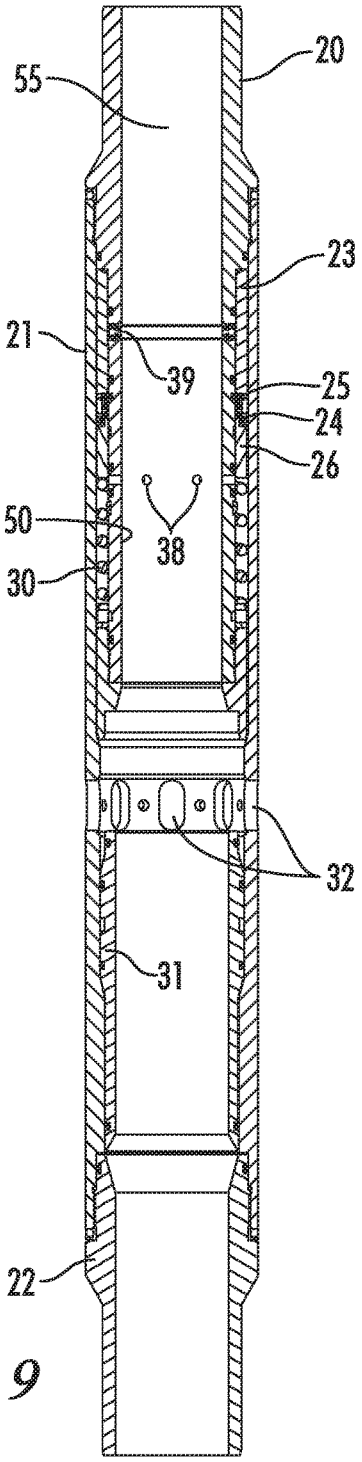
FIG. 9 is a cross sectional of the toe valve of FIG. 2 with the toe valve opened.
Figure 10:
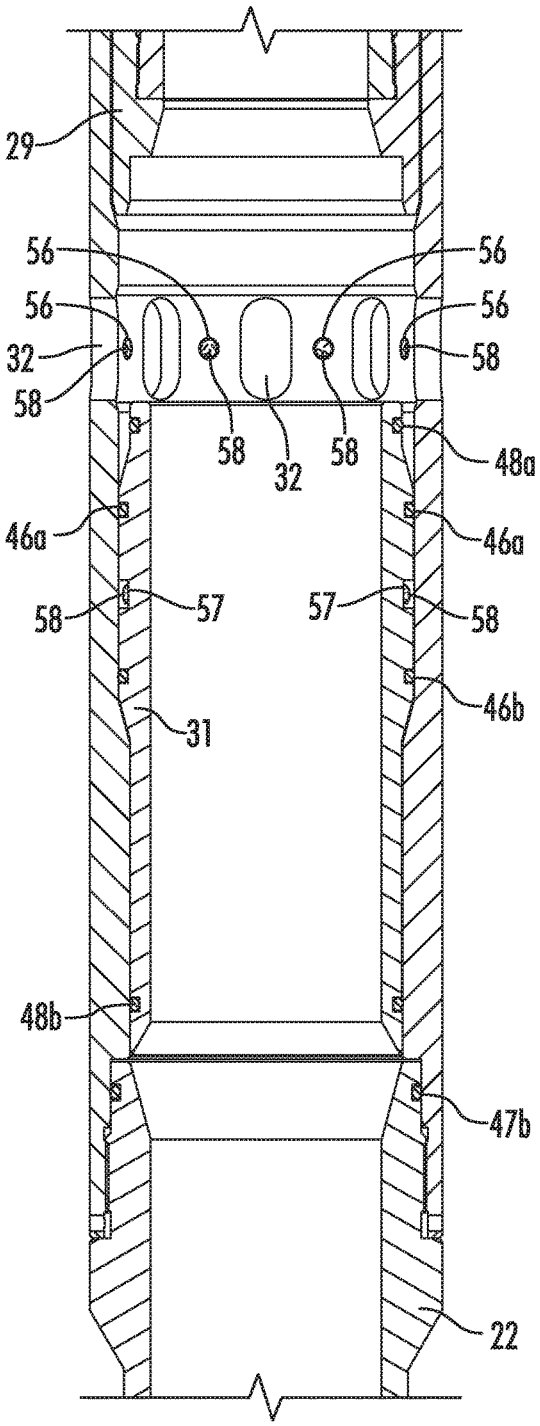
FIG. 10 is an expanded cross sectional view of the toe valve of FIG. 9.
Figure 11:
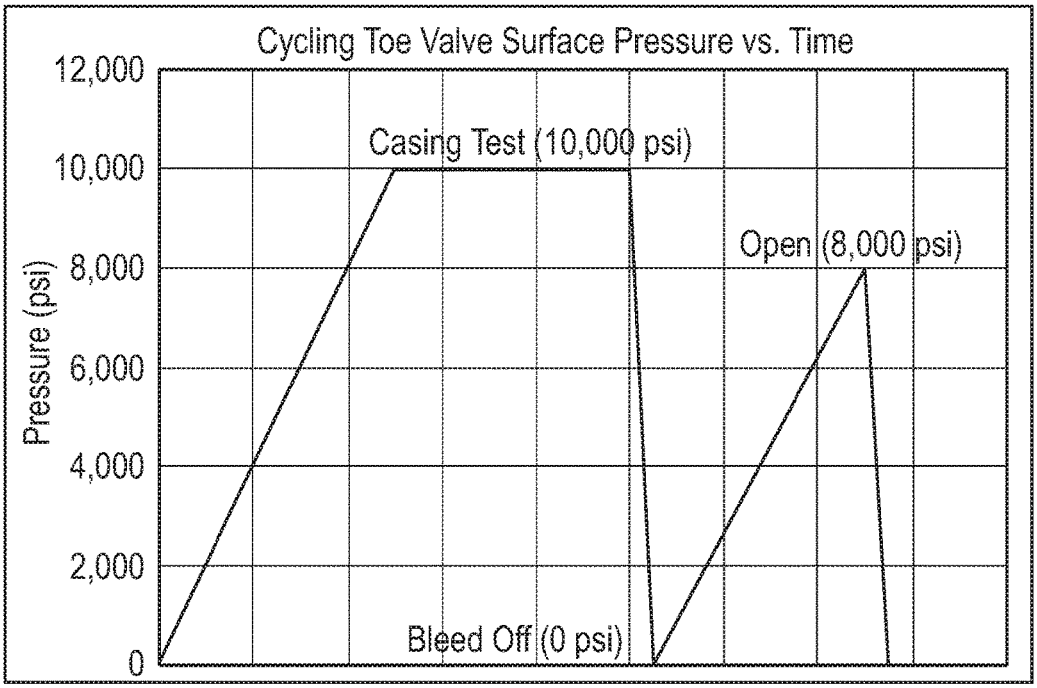
FIG. 11 is a graph showing pressure versus time to deploy an embodiment of the toe valve of FIG. 2.
Figure 12:
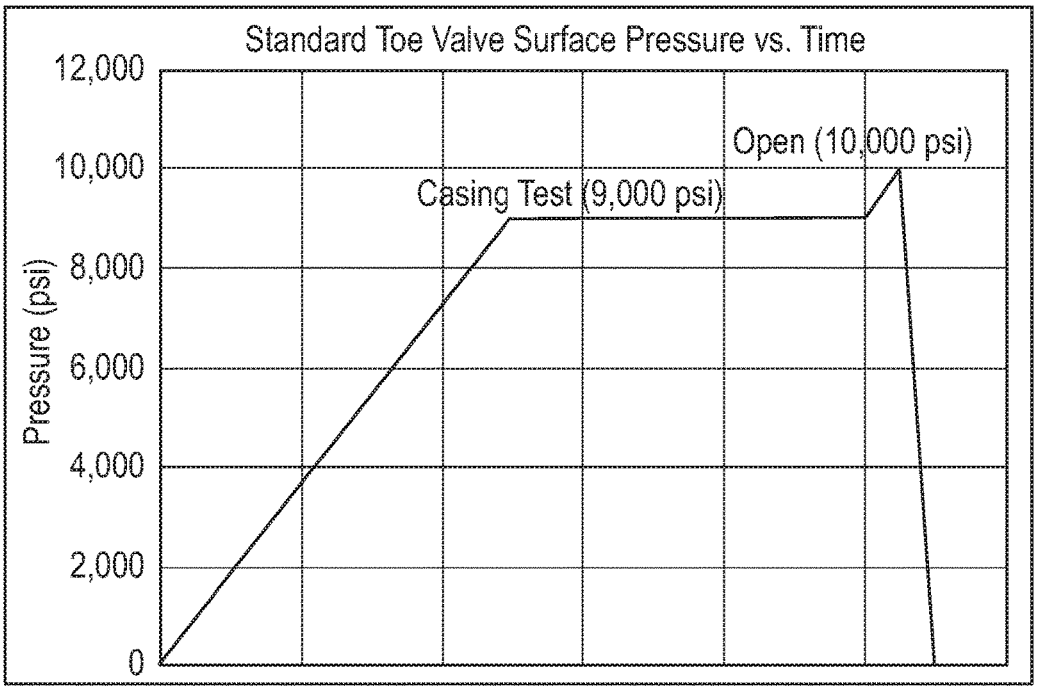
FIG. 12 (PRIOR ART)
FIG. 12 (prior art) is a graph showing the pressure cycle versus time to deploy a known toe valve.

FIGS. 5-10 show overall and expanded cross sectional views of toe valve 5 when unlocked, armed and actuated. FIG. 11 is a graph showing an exemplary sequence of pressures that can be applied at the surface to the tubular string bore to deploy toe valve 5. It will be understood that the following explanation of the embodiments shown in FIGS. 5-11 with reference to FIG. 11 is merely exemplary, and operation of toe valve 5 is not limited to the specific pressures and timing that may be suggested by FIG. 11.

Figure 5:
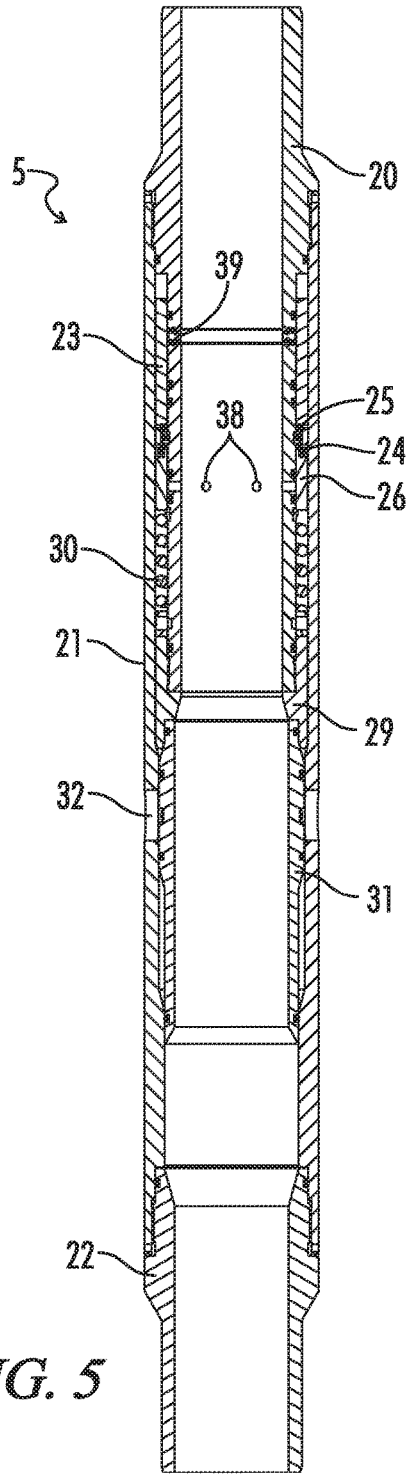
FIG. 5 is a cross sectional of the toe valve of FIG. 2 with the toe valve unlocked.
Figure 6:
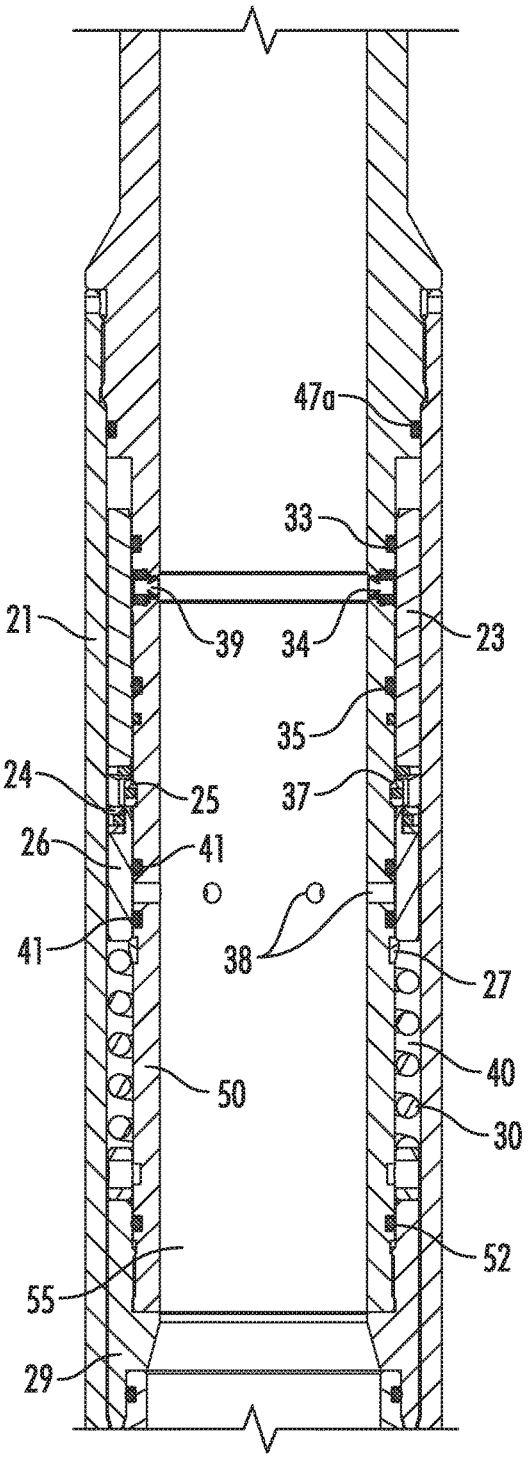
FIG. 6 is an expanded cross sectional view of the toe valve of FIG. 5.

As shown in FIG. 11, surface pumps increase surface pressure in the bore of the tubular string to reach a desired casing test pressure, shown here as 10,000 psi. As best shown in FIGS. 5 and 6, the fluid pressure in tool bore 55 correspondingly increases to a first pressure, such as a test pressure, breaking rupture disk 34 which is exposed to the fluid pressure via unlocking port 39. Once the rupture disk 34 has ruptured, the actuating surface of unlocking piston 23 is exposed to this elevated pressure. Because main chamber 40 remains at a much lower pressure near atmospheric, unlocking piston 23 is forced to slide axially into capture ring 24 and displaces it into the recess in cover ring 26. Assembly shear pins 36 in the unlocking piston 23, in the capture ring 24, and in the locking ring 25 assembly are broken in the process. Although the tool is now unlocked, the continuing high pressure from the tool bore 55 into unlocking port 39 keeps cover ring 26 in its original position and keeps housing port 38 closed. Although the force from unlocking piston 23 may otherwise overwhelm spring 30 and push cover ring 26 backwards into spring 30 to uncover housing port 30, stroke ring 27 protrudes from its groove in the inner wall 50 and prevents further backwards motion into spring 30. The pressure at the unlocking port, and hence the well test pressure can be maintained indefinitely without deploying the toe valve 5 or adversely affecting the tool.

Figure 7:
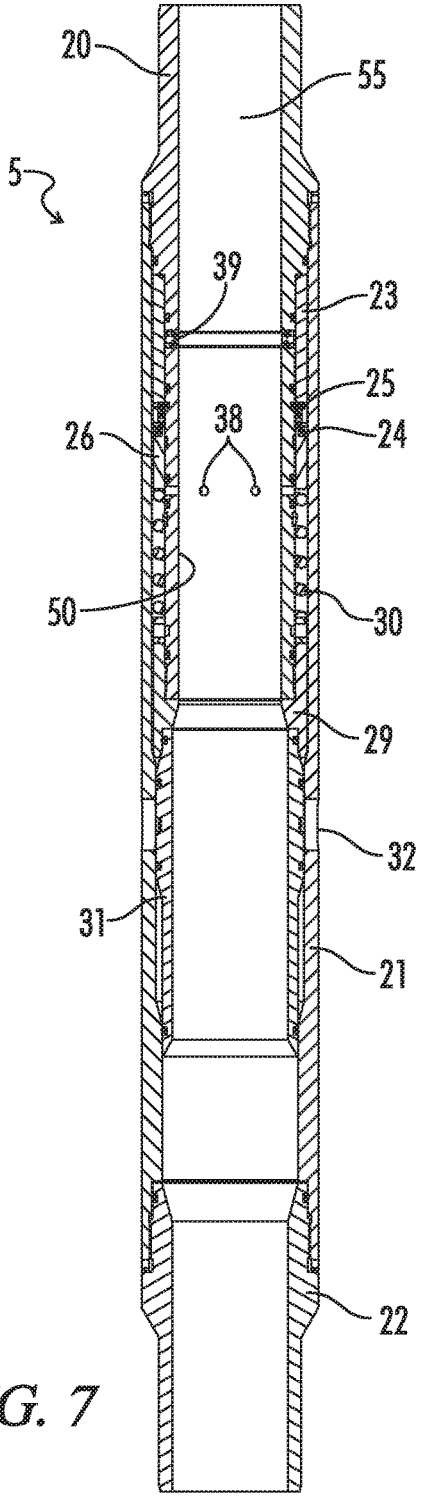
FIG. 7 is a cross sectional of the toe valve of FIG. 2 with the toe valve armed.
Figure 8:
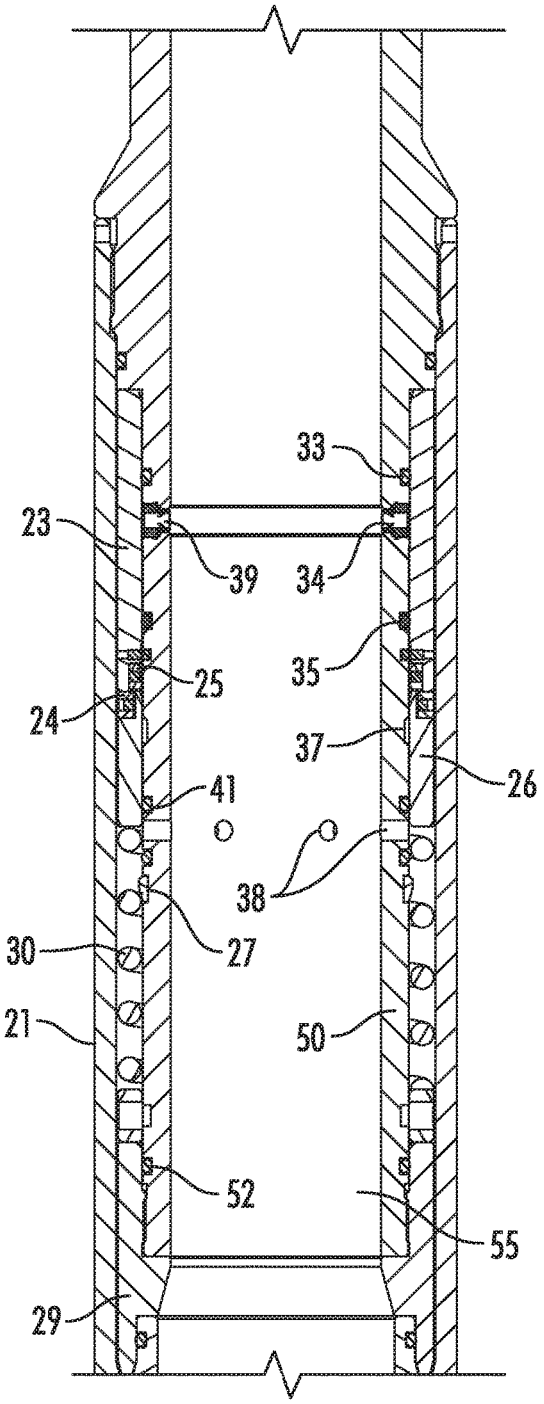
FIG. 8 is an expanded cross sectional view of the toe valve of FIG. 7.

When the casing pressure test is complete, the pumps can be stopped and pressure in the tubular string bled off to 0 psi at the surface, as shown in FIG. 11. As the pressure in the tubular string bore bleeds off, pressure at unlocking port 39 drops until a point where the force that spring 30 exerts on cover ring 26 exceeds the force of unlocking piston 23 in the opposite direction. When the force of spring 30 sufficiently exceeds unlocking piston 23, cover ring 26 is able to displace lock ring 25, which is no longer retained by capture ring 24, axially out of groove 37 and push lock ring 25 together with unlocking piston 23 until cover ring 26 no longer covers and seals housing port 38. The toe valve 5 in this configuration is best shown in FIGS. 7 and 8.

With housing port 38 open, main chamber 40 of the toe valve housing is now exposed to pressure exerted by fluid in the tubular string. The toe valve 5 is now armed so that subsequent increases in tool bore pressure can actuate toe valve 5. However, it will be understood that this unlocking, arming and actuating mechanism is not limited to toe valves. A wide variety of tools can be actuated by appropriately coupling an appropriate piston to the housing so that the piston's actuating surface is in fluid communication with main chamber 40.

It will also be understood that although the pressure in main chamber 40 is exerted by fluid through housing port 38, the applied pressure corresponds to different pressures at different elevations in the tubular string bore, such as at the unlocking port 39 and at the surface of the well 1. It will further be understood that such differences in corresponding pressure are generally caused by the head pressure due to the weight of the intervening column of fluid between the different elevational points.

In the instant toe valve 5, main chamber 40 is in fluid communication with high pressure chamber 54. As fluid from tool bore 55 applies pressure to main chamber 40 and, accordingly, to high pressure chamber 54, the pressure produces a resulting force on the actuating surface of valve piston 31. The pressure in low pressure chamber 45 is lower than the corresponding pressure in the tool bore, and preferably at or near atmospheric pressure. Accordingly, as pressure in tool bore 55 increases, for example, to a fracturing pressure, the corresponding pressure in main chamber 40 and high pressure chamber 54 also increases. The resulting force on valve piston 31 eventually shears shear screws 58 and forces valve piston 31 to slide axially and decouple from nut 29. (FIG. 11 shows the exemplary surface pressure increasing to 8,000 psi.) But even when valve piston 31 is decoupled, tool bore pressure acting directly on the actuating surface of valve piston 31 continues to push valve piston 31 until valve port 32 is uncovered. The toe valve 5, with valve piston 31 actuated and valve port 32 opened is best seen in FIGS. 9 and 10. As shown in FIG. 11, with valve port 32 open, surface pressure drops.

Thus, although there have been described particular embodiments of the present invention of a new and useful it is not intended that such references be construed as limitations upon the scope of this invention except as set forth in the following claims.

What is claimed is:

1. A downhole tool adapted for assembly into a tubular string for a well, the tool comprising:

(a) a main chamber between an outer wall and an inner wall, the inner wall surrounding an axial bore;

(b) a first port and a second port in the inner wall, the first and second ports being spaced axially relative to each other;

(c) an unlocking piston slidably mounted in the main chamber;

(d) an arming sleeve slidably mounted in the main chamber, the arming sleeve being releasably locked in a position covering the second port;

(e) wherein the unlocking piston is adapted for actuation by a pressure at the first port to unlock the arming sleeve; and (f) wherein the arming sleeve, after being unlocked by the unlocking piston, is adapted for actuation to uncover the second port in response to lowering said pressure at the first port.

2. The downhole tool of claim 1 further comprising:

(a) a lock ring releasably affixed at an axial position in the main chamber between the unlocking piston and the arming sleeve, the releasable lock ring retaining the arming sleeve in the position covering the second port; and (b) a displaceable capture ring between the lock ring and the outer wall, the capture ring retaining the lock ring in the axial position.

3. The downhole tool of claim 1 wherein:

(a) the unlocking piston is slidably mounted on and around the inner wall and has an inner actuation surface providing a hydraulic chamber between the unlocking piston and the inner wall;

(b) wherein the first port is adapted to provide fluid communication between the axial bore and the hydraulic chamber.

4. The downhole tool of claim 1 wherein the arming sleeve is slidably mounted on and around the inner wall and seals across the second port.

5. The downhole tool of claim 1 wherein:

(a) the outer wall includes a valve port; and (b) the tool comprises a valve piston slidably mounted on and within the outer wall, the valve piston having an initial position covering the valve port;

(c) wherein the valve piston is adapted for actuation by a pressure at the uncovered second port to uncover the valve port;

(d) wherein the pressure at the uncovered second port is less than the pressure applied at the first port to unlock the arming sleeve.

6. The downhole tool of claim 5 further comprising a second chamber between the outer wall and the valve piston, said second chamber having a pressure lower than the pressure at the second port actuating the valve piston.

7. The downhole tool of claim 1 wherein said tool is a toe valve.

8. A toe valve adapted for assembly into a tubular string for a well, the toe valve comprising:

(a) an outer tubular wall;

(b) an inner tubular wall concentrically disposed within the outer wall and surrounding an axial bore, the inner wall having a first port and an axially spaced second port;

(c) a first chamber between the outer wall and the inner wall;

(d) an unlocking piston slidably mounted in the first chamber and having an inner actuation surface providing a hydraulic chamber between the unlocking piston and the inner wall;

(e) wherein the first port has a rupture disc forming a breakable seal between the axial bore and the hydraulic chamber;

(f) an arming sleeve slidably mounted in the first chamber, the arming sleeve covering said second port;

(g) a spring loaded against the arming sleeve in an axial direction towards the unlocking piston;

(h) a lock ring releasably affixed at an axial position in the first chamber between the unlocking piston and the arming sleeve; and (i) a capture ring disposed between the lock ring and the outer wall.

9. The toe valve of claim 8 further comprising a second piston hydraulically coupled to the first chamber and actuatable in response to a hydraulic pressure in the first chamber.

10. The toe valve of claim 9 further comprising:

(a) a valve port in the outer wall; and (b) wherein the second piston is a valve piston adapted for actuation from a position covering the valve port to a position where the valve port is uncovered.

11. The toe valve of claim 10 wherein:

(a) the valve piston forms a second chamber between the valve piston and the outer wall; and (b) wherein the valve piston is adapted to uncover the valve port in response to a hydraulic pressure in the first chamber greater than a pressure in the second chamber.

12. The toe valve of claim 8 wherein the unlocking piston is moveable from a first position to a second position to displace the capture ring into a recess in the arming sleeve.

13. The toe valve of claim 12 wherein the unlocking piston is moveable from the first position to the second position by applying a fluid pressure greater than a selectable unlocking fluid pressure at the first port.

14. The toe valve of claim 13 wherein the rupture disk is adapted to rupture at the unlocking fluid pressure.

15. The toe valve of claim 8 wherein the arming sleeve is moveable to displace the lock ring and uncover the second port.

16. The toe valve of claim 15 wherein the arming sleeve is moveable in response to reducing fluid pressure applied at the first port from a pressure sufficient to rupture the rupture disc.

17. A method of deploying a downhole tool, the tool having a substantially tubular outer tool wall, a substantially annular housing within the tool wall and a concentric axial tool bore extending through the housing, the tool bore containing a fluid at a fluid pressure, the method comprising:

(a) increasing the fluid pressure in the tool bore to a first pressure to unlock the tool;

(b) reducing the fluid pressure in the tool bore to open a port in the housing adapted to allow fluid communication between the housing and the axial bore; and (c) increasing the fluid pressure in the tool bore to a second pressure to induce fluid flow through the open port and actuate the tool, wherein the second pressure is less than the first pressure.

18. The method of claim 17 wherein unlocking the tool comprises moving an unlocking piston in the housing from a first position to a second position axially spaced from the first position to unlock an arming sleeve, the unlocking piston having an actuating surface in fluid communication with the tool bore.

19. The method of claim 17 wherein opening the housing port comprises moving an arming sleeve to uncover the housing port.

20. The method of claim 17, wherein:

(a) the tool includes a valve port forming an opening in the outer tool wall and a valve piston coupled to and in fluid communication with the housing, and (b) actuating further includes axially displacing the valve piston in response to the second fluid pressure being applied through the open housing port.

21. The method of claim 17, wherein said downhole tool is a toe valve.

* * * * *